US005544383A

United States Patent [19]

Gamble

[11] Patent Number: 5,544,383

[45] Date of Patent: Aug. 13, 1996

[54] TOOTHBRUSH

[76] Inventor: John A. Gamble, 609 Country Club Rd., La Grange, Ga. 30240

[21] Appl. No.: 505,699

[22] Filed: Jul. 21, 1995

[51] Int. Cl.[6] ..... A46B 9/04

[52] U.S. Cl. ..... 15/106; 15/167.1; 15/167.2; 15/DIG. 5; D4/104; D4/105

[58] Field of Search ..... 15/106, 159.1, 15/160, 167.1, 167.2, DIG. 5; D4/104–106, 119, 120

[56] References Cited

U.S. PATENT DOCUMENTS

| | | | |
|---|---|---|---|
| 282,137 | 7/1883 | White | 15/160 |
| 1,452,108 | 4/1923 | Carter | 15/167.1 |
| 2,244,615 | 6/1941 | Garcin | 15/167.2 |
| 3,618,154 | 11/1971 | Muhler et al. | 15/187 |
| 4,010,509 | 3/1977 | Huish | 15/DIG. 5 |
| 4,328,604 | 5/1982 | Adams | 15/110 |
| 4,517,701 | 5/1985 | Stanford, Jr. | 15/106 |
| 5,027,463 | 7/1991 | Daub | 15/22.1 |
| 5,305,489 | 4/1994 | Lage | 15/167.1 |
| 5,355,546 | 10/1994 | Scheier et al. | 15/167.2 |

FOREIGN PATENT DOCUMENTS

| | | | |
|---|---|---|---|
| 285121 | 10/1988 | European Pat. Off. | 15/167.1 |
| 295900 | 12/1988 | European Pat. Off. | 15/159.1 |
| 1296557 | 5/1962 | France | 15/167.1 |
| 820887 | 11/1951 | Germany | 15/160 |

*Primary Examiner*—Mark Spisich
*Attorney, Agent, or Firm*—Robert E. Massa

[57] ABSTRACT

A toothbrush which provides the user with simultaneous brushing action within the user's mouth. The long handle has an end portion of a substantially elliptical cross section in which a first side and a second side are of substantially similar elliptical curvature. Bristles are attached to both the first side and the second side in a similar pattern. The bristles on each side taper from a short extant near the end of the handle to a longer extant at a position farther from the end of the handle. Also, the bristles are formed in tufts substantially in rows latitudinally of the two sides.

7 Claims, 1 Drawing Sheet

TOOTHBRUSH

FIELD OF THE INVENTION

Invention relates to toothbrushes, and more and more particularly, to toothbrushes which are adapted to provide simultansous brushing action to two distinct areas within a user's mouth in an efficient, thorough, and comfortable manner. Still more particularly, my invention relates to toothbrushes which have bristles positioned most advantageously upon a handle of unique design in order to provide the most convenient and complete brushing action against two sides of the interior of the user's mouth simultaneously.

BACKGROUND OF THE INVENTION

I am thoroughly aware of the knowledge existent within the dental profession that the average person is extremely lax with the care of the teeth.

If we were to question someone during treating within the dentist's office about the amount of time spent each day on brushing of the teeth, I am sure the answer would be "I don't have time to do much brushing", or "I think I do enough brushing." Also, I am sure that if we questioned that person about his or her action in brushing other areas within the mouth, that person would probably say "I don't brush any place but my teeth", or "I don't think it is necessary to try to brush any place but my teeth", or "I understand that the teeth are the only significant areas which should be brushed only to remove plaque".

We have seen and heard many reports and recommendations for many years that plaque is the dangerous culprit residing on the teeth and soft tissues which must be removed and prevented by consistent and thorough brushing.

However, not enough has been stressed about the danger of the various bacteria which are allowed to grow and remain in tiny fissures between adjacent teeth, or in crevices within soft tissues of the mouth. These must be removed by persistent brushing and cleaning of the teeth and soft tissues within the mouth and conscientious flossing of remaining areas.

Poor dental hygiene leads to diseases of the gums, commonly known as gingivitis, the most frequent of the gum diseases.

Gingivitis usually starts at restricted areas of the mouth, such as between the teeth or between the teeth and gum edges. Inflammation which arises may continue to develop, and eventually lead to bleeding of the gums. If not properly treated, the teeth may become loosened, and even eventually require extraction.

Another area of great dental concern is the destruction of teeth by decay caused by acid products formed by bacterial reaction with certain food material allowed to remain too long in the mouth. The result of this form of dental decay is referred to as dental caries.

Again, we must assume that the greatest cause of the gingivitis and dental caries is poor oral hygiene, which might be blamed upon one or more of several primary actions, such as lack of knowledge upon the part of the patient, assumption by the patient that thorough cleansing has been achieved, or most importantly, improper or inefficient cleansing devices, including toothbrushes not adapted for thorough cleansing, and lack of flossing.

As a result of my long experience as a dentist and my long study of tooth cleansing devices, I cannot accept the excuses outlined above for not including the soft tissues of the mouth during thorough brushing of the teeth.

Further, in my long experience I have not seen a toothbrush of construction similar to my toothbrush.

In accordance with the usual procedure, I have conducted a patent search which revealed the following patents which were considered to be the closest to my invention:

| | | |
|---|---|---|
| U.S. 2,244,615 | Garcin | June 3, 1941 |
| U.S. 4,328,604 | Adams | May 11, 1982 |
| U.S. 4,517,701 | Stanford, Jr. | May 21, 1985 |
| U.S. 5,027,463 | Daub | July 2, 1991 |

U.S. Pat. No. 2,244,615 to Garcin describes a toothbrush wherein lateral rows of bristles are longer than middle rows thus forming a longitudinal channel by which the brush will be guided by the teeth whose inner and outer sides are brushed at the same time by the lateral rows of bristles while the cusps are brushed by the short middle bristles. Another characteristic is that the lateral bristles have preferably an oblique position in the transverse direction, and their ends converge towards the middle longitudinal plane so that the ends of these bristles act at a better angle upon the lateral faces of the teeth.

U.S. Pat. No. 4,328,604 to Adams describes a toothbrush in which ordinary toothbrush bristles are affixed to a first surface of the toothbrush handle at the end thereof, in the usual and customary manner, and mouth bristles, which are shorter and more flexible than the aforesaid toothbrush bristles, are attached to and/or protrude from all exposed surfaces of the toothbrush handle beginning at that end of the toothbrush handle which has the toothbrush bristles attached and ending at some point along the length of the toothbrush handle which coincides roughly with the point at which the toothbrush bristles are no longer attached to the toothbrush handle.

U.S. Pat. No. 4,517,701 to Stanford, Jr., describes a toothbrush provided specifically for cleaning sulcular areas of the teeth below the gum line. The brush head is curved and has bristles extending from opposite sides thereof, facilitating an improved access to the teeth, particularly at the gingival margins. In one embodiment, the bristles are arranged in rows which may be canted inward along the curve, with tufts on opposite sides of the curved brushing head providing access to oppositely curved dental profiles. In a second embodiment, the bristles are arranged in a single row on a miniaturized brush head. The miniaturized arrangement is particularly suited for cleaning of the sulcular areas, both at and below the gum lines in the treatment of periodontal diseases.

U.S. Pat. No. 5,027,463 to Daub describes a power-driven toothbrush which includes a bristle support member which anchors bristles from opposite surfaces thereof. The bristles are arranged in longitudinal rows including central rows, intermediate rows, and outer rows. The central rows are straight while the intermediate and outer rows are curved for engaging the lingual and buccal surfaces.

SUMMARY OF THE INVENTION

The primary object of my invention is to provide a toothbrush which is easy to use, efficient, and inexpensive.

Another object of my invention is to provide a toothbrush which is capable of brushing more than one surface of a user's teeth at the same time.

Still another object of my invention is to provide a toothbrush which is adapted to brush multiple surfaces within the user's mouth simultaneously.

Still another object of my invention is to provide a toothbrush which is adapted to brush and clean various tooth surfaces and various mouth surfaces at the same time.

Still another object of my invention is to provide a toothbrush which is adapted to brush and clean tooth surfaces and soft tissue surfaces of the mouth simultaneously.

Still another object of my invention is to provide a toothbrush which is adapted to brush and clean inner surfaces of the cheeks, lips, or tongue, as desired, while brushing nearby teeth.

Still another object of my invention is to provide a toothbrush which is structured to provide extremely efficient brushing and cleaning actions for the teeth and inner surfaces of the mouth.

In using a toothbrush constructed according to my invention, the user is automatically and necessarily brushing two distinct areas within the mouth.

For example, if the individual using my toothbrush is brushing the upper chewing surfaces of the lower teeth, he or she is automatically brushing the lower chewing surfaces of the upper teeth at the same time. This is whether he or she intended to accomplish this action, or even knew ahead of time that this action would be accomplished.

Further, when the user is brushing an inner surface of either the upper or lower teeth, he or she will be automatically brushing and cleaning the adjacent surface of the tongue or adjacent soft tissue.

For most effective use, the bristles on my toothbrush should be soft Nylon or other soft plastic with each bristle having a rounded tip.

As I stated, I have designed my toothbrush to be effective and efficient in brushing action by designing it to accomplish simultaneous brushing action in more than one area of the mouth. That is, against at least two surfaces at the same time. However, only some of the inner surfaces of the upper and lower teeth might have to be brushed separately. This is because of the necessity of requiring the mouth to be held slightly open while brushing each of these surfaces thoroughly.

The simultaneous brushing action of my toothbrush is accomplished by two major design features. The bristles are on opposite sides of the toothbrush handle, and a second feature is that the bristles on each side of the handle taper from a shorter extant near the end of the handle to a longer extant farther from the end of the handle.

I subsequently shall describe in detail other major features of my toothbrush.

Then, the above objects and advantages of my invention will become apparent from my description of the following preferred embodiments of my invention.

BRIEF DESCRIPTIONS OF THE DRAWINGS

DESCRIPTION OF THE PREFERRED EMBODIMENTS

Figure 1:
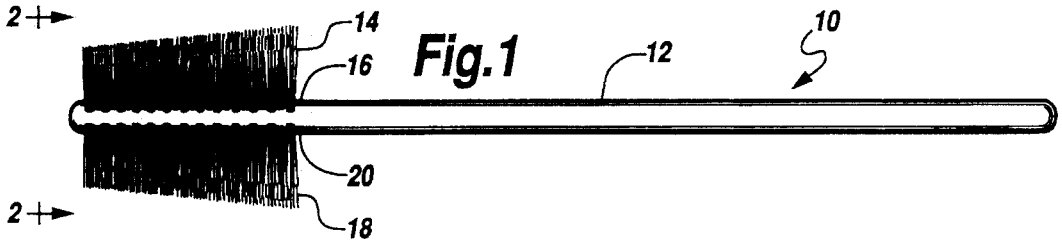
FIG. 1 is a side view of a toothbrush according to my invention.

FIG. 1 is a side view of my toothbrush 10, generally, showing handle 12, and bristles 14 on a first side 16 and bristles 18 on a second side 20. For most effective brushing and cleaning action, the bristles 14 and 18 should be formed of flexible plastic material, such as Nylon, and have rounded tips to prevent injury to soft areas of the mouth and gums.

In FIG. 1 I show how the bristles on each side of the handle taper from a short configuration near the end of the handle to a longer configuration farther from the end of the handle.

I describe these tapering features as tapering from shorter extants to longer extants.

Also, these bristles are imbedded in the typical manner into the handle 12.

Figure 2:
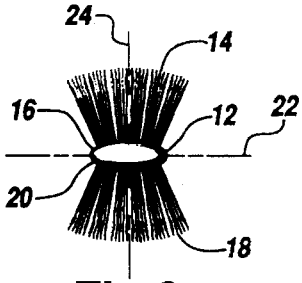
FIG. 2 is an end view of a toothbrush according to my invention along the lines 2—2 of FIG. 1.

In FIG. 2 I show a cross sectional view of the toothbrush according to the lines 2—2 set out in FIG. 1.

In FIG. 2 the handle portion 12 of my toothbrush may be a typical configuration, but, at the brushing end of my toothbrush, I determined that for my purposes the brush end of the handle should be elliptical as I show.

As shown in FIG. 1, the bristles 14 and 18 are formed in tufts substantially in rows latitudinally of the sides 16 and 20.

In the cross-sectional view shown in FIG. 2, the bristles 14 and 18 in each latitudinal row are all of equal length and the ends of the bristles correspond elliptically to the elliptical surfaces 16 and 20 of the handle portion 12.

The construction of my toothbrush, as it is shown in FIGS. 1 and 2, shows clearly the important structural features of my toothbrush, specifically indicating the major elliptical axis 22 and minor axis 24, which are respectively parallel to the typical similar configurations of handle 12.

The configurations of my toothbrush 10 which I show in FIGS. 1 and 2 are ideal for the purposes of my invention, in carrying out the operations of my invention as I show and describe in FIGS. 3 through 6.

Figure 3:
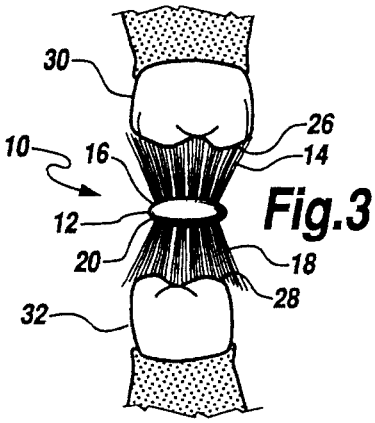
FIG. 3 is a sectional view similar to FIG. 2 of a toothbrush according to my invention showing the toothbrush in operating position between the chewing surfaces of upper and lower teeth as they would be brushed simultaneously.

In FIG. 3 I show my toothbrush 10 in use in brushing simultaneous chewing surfaces 26 and 28 of one group of teeth as envisioned by upper tooth 30 and lower tooth 32. As shown, and easily understood, the user is easily brushing the chewing surfaces of the upper and lower teeth without difficulty.

I show FIG. 3 as a means of easily and quickly understanding the use of my invention. Of course, toothpaste has been placed upon the toothbrush 10 and has spread addedly through the bristles.

Figure 4:
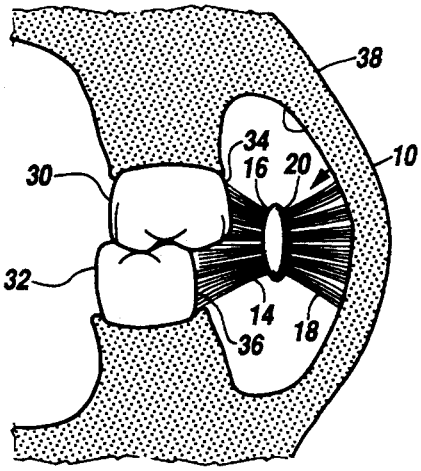
FIG. 4 is a sectional view of a toothbrush according to my invention as it would be in operating position for brushing and cleaning upper teeth, lower teeth, and inner cheek surfaces simultaneously.

In using my toothbrush as described in FIG. 4, the user is brushing outer surface 34 of upper tooth 30 and outer surface 36 of lower tooth 32 while simultaneously cleaning the inner surface 38 of user's cheek. In performing this operation, user should clench the back teeth, vibrate the brush for one or two seconds, move the brush forward approximately one brush length, and vibrate the brush for one or two seconds, and continue to do this to the midline of the face. The user should then invert the brush and repeat this operation on the opposite side of the face. Then, this operation completes the brushing and cleaning of the outer surfaces of the teeth and inner surfaces of the cheeks and lips.

Figure 5:
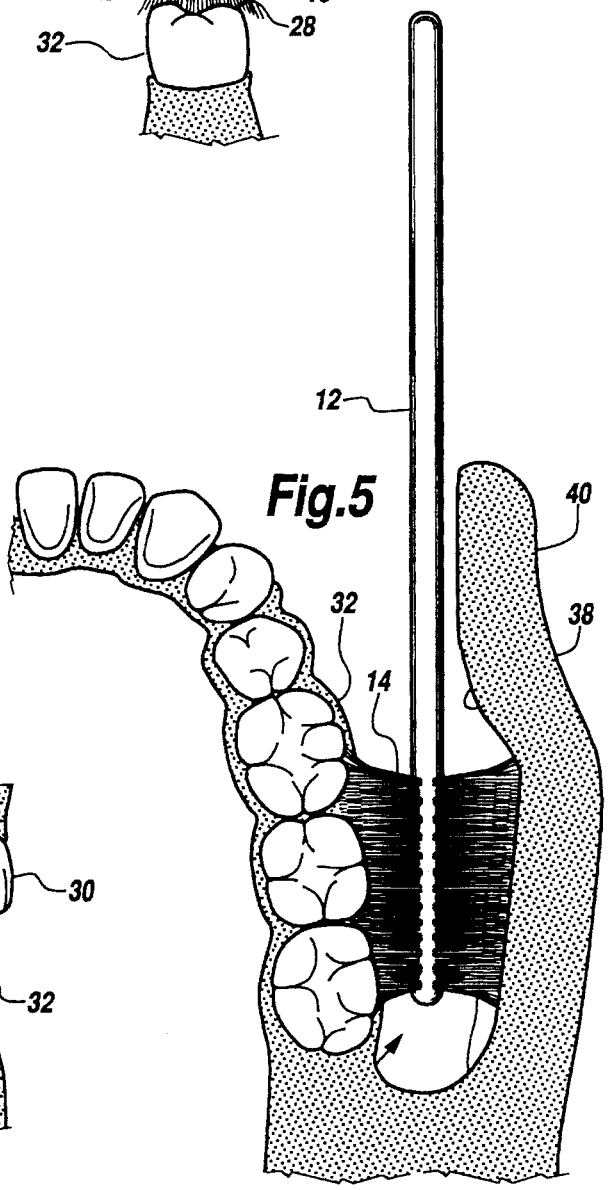
FIG. 5 is a top view of a toothbrush according to my invention as it would be in operating position in brushing lower arch and cleaning of portion of cheek simultaneously.

FIG. 5 is a top view of the brushing and cleaning action described in FIG. 4 in which the brush 10 is extended between the inner surface 38 of cheek 40 and tongue 42. This shows that the tapered structures of the toothbrush 10 permit the brush to have access to rear portions of the mouth. With this view the upper arch within the mouth is not shown even though it is being thoroughly brushed simultaneously.

Figure 6:
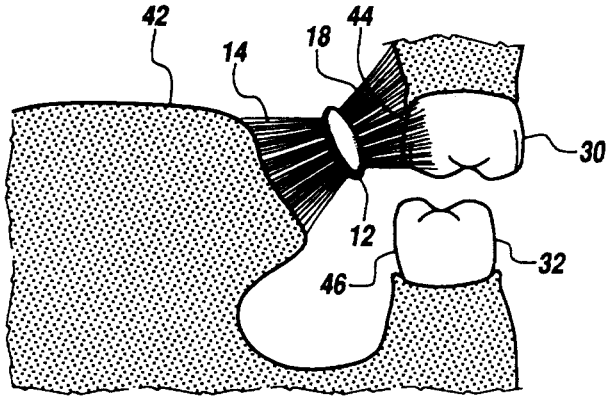
FIG. 6 is a sectional view of a toothbrush according to my invention as it would be in operating position in brushing an inner tooth surface and cleaning a portion of tongue simultaneously.

FIG. 6 describes the brushing action of the inner surfaces 44 of upper teeth 30, inner surface 46 of lower teeth 32 as they are being brushed separately as I had described above, along with the cleaning action of brushing of the tongue 42.

With my toothbrush the user shall find it easy to brush the teeth and remove food debris and bacteria from the mouth simultaneously.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. A toothbrush comprising:

a longitudinal handle having an end portion of substantially elliptical cross section in which a first side and a second side thereof are of substantially similar elliptical curvature, the end portion is of substantially the same elliptical cross section along the length of the end portion, a plurality of bristles are attached to the aforesaid first and second sides, and the bristles on both said first and second sides taper positionably from a shorter extant near a free end of the end portion to a longer extant farther from the free end of the end portion and adjacent said handle, whereby the end portion may provide a user with simultaneous brushing action to two distinct areas within the user's mouth.

2. A toothbrush as described in claim 1, wherein the bristles are formed in tufts substantially in rows latitudinally of the sides, and the bristles in each row are of equal length.

3. A toothbrush as described in claim 2, wherein the bristles are formed of soft plastic material having rounded tips.

4. A toothbrush as described in claim 1, wherein the bristles are formed of soft plastic material having rounded tips.

5. A toothbrush as described in claim 1, wherein the end portion of substantially elliptical cross section has major and minor elliptical axes transversely of the handle.

6. A toothbrush as described in claim 5, wherein the bristles are formed in tufts substantially in rows latitudinally of the sides, and the bristles in each row are of equal length.

7. A toothbrush as described in claim 6, wherein the bristles are formed of soft plastic material having rounded tips.

* * * * *

UNITED STATES PATENT AND TRADEMARK OFFICE

CERTIFICATE OF CORRECTION

PATENT NO. : 5,544,383

DATED : August 13, 1996

INVENTOR(S) : GAMBLE, John A.

It is certified that error appears in the above-identified patent and that said Letters Patent is hereby corrected as shown below:

Column 1, line 4, change "Invention" to ---invention---.

Column 1, line 4, before the word "invention", add the word ---My---.

Column 1, line 6, change "simultansous" to ---simultaneous---.

Signed and Sealed this

Twenty-second Day of October, 1996

*Attest:*

Bruce Lehman

BRUCE LEHMAN

*Attesting Officer*

*Commissioner of Patents and Trademarks*